US006945534B1

(12) United States Patent
Lindsey

(10) Patent No.: US 6,945,534 B1
(45) Date of Patent: Sep. 20, 2005

(54) MECHANICAL ROPING PRACTICE DEVICE

(75) Inventor: Billy Rex Lindsey, Colcord, OK (US)

(73) Assignee: Billy Rex Lindsey, Jr., Huntsville, AR (US)

( * ) Notice: Subject to any disclaimer, the term of this patent is extended or adjusted under 35 U.S.C. 154(b) by 0 days.

(21) Appl. No.: 10/838,067

(22) Filed: May 4, 2004

(51) Int. Cl.[7] ..... A63B 69/00; A01K 15/02
(52) U.S. Cl. ..... 273/359; 119/839
(58) Field of Search ..... 273/336, 317, 273/348, 359; 119/839

(56) References Cited

U.S. PATENT DOCUMENTS

| | | | | |
|---|---|---|---|---|
| 3,711,098 | A | 1/1973 | McCord | |
| 3,802,706 | A | 4/1974 | Hamm | |
| 3,947,033 | A | 3/1976 | Bennett | |
| 4,266,779 | A | 5/1981 | English | |
| 4,286,788 | A | 9/1981 | Simington | |
| 4,981,302 | A | 1/1991 | Narramore | |
| 4,995,618 | A | 2/1991 | Panzner | |
| 5,009,432 | A | 4/1991 | Richard | |
| 5,192,210 | A | 3/1993 | Thomas | |
| 5,568,926 | A | 10/1996 | Kaptein | |
| 5,709,386 | A | 1/1998 | Nelson | |
| 6,497,411 | B1 | 12/2002 | Nelson | |
| 6,629,695 | B2 * | 10/2003 | Tisdell | 273/359 |
| 6,736,399 | B1 * | 5/2004 | Copenhaver | 273/339 |
| 2003/0034613 | A1 * | 2/2003 | Tisdell | 273/359 |

* cited by examiner

*Primary Examiner*—Raleigh W. Chiu

(57) ABSTRACT

A system for roping practice by horse mounted individuals uses a wheel mounted target simulating a live animal and a spring driven tow cable arrangement to impart movement to the target. The system includes means to restrain the target against movement until released by a latch actuated by a hand line held by the horse mounted person or an assistant. The target rolls freely on wheels and includes a brake that causes the target to stop quickly when the tow cable tension is relieved. Construction of the target frame is such that various commonly available molded plastic steer heads can be attached.

16 Claims, 4 Drawing Sheets

MECHANICAL ROPING PRACTICE DEVICE

BACKGROUND OF THE INVENTION

The art of roping of animals on ranches for the purposes of counting, medical treatment, and general handling has developed into various sports involving horse mounted individuals roping running animals in the quickest possible manner. Practice of the sport is problematic as a limited number of live animals are available, and repetitive roping of them imparts cumulative stress to the animal. Consequently, many efforts have been made to build mechanical apparatuses to allow practice of roping skills. The simplest of these consist merely of a non-moving roping target that simulates a target animal, or sometimes just the head of a target animal. More sophisticated solutions to the need use a construction that simulates a target animal and is towed by some means such that the horse mounted roper must pursue the moving target and cast the rope about the target while moving. Finding a suitable means of towing the target is a considerable challenge as evidenced by the many schemes that have been patented.

DESCRIPTION OF PRIOR ART

Various devices and systems for the purpose of enabling roping practice without the use of live target animals are known to the art. Among these are U.S. Pat. No. 4,266,779 which describes an apparatus in which a towrope attached to the roper's horse imparts forward motion to a wheel mounted roping target by means of the rope passing over various pulleys attached to appropriately positioned fixed posts positioned around the perimeter of the practice field. This system, while workable, imposes severe limitations on the movement of the roper and horse because of the attachment of the towrope. Representative of various roping practice systems that use electrical or engine driven towing apparatuses is U.S. Pat. No. 3,711,098. This patent depicts a wheeled towing apparatus utilizing an electric motor to pull in a tow cable attached to a simulated target animal. This and other inventions of this type have the disadvantage of weight and expense of the motor driven towing apparatus. When the apparatus is electric motor driven there is the additional disadvantage of the necessity of either having a connection to an electric line, or large electric storage batteries. U.S. Pat. No. 3,947,033 discloses a steer roping practice device that uses a cart mounted target animal towed by a winch driven by an inertia motor, but this too requires an outside power source to build up the inertia in the motor. U.S. Pat. No. 5,568,926 teaches a target animal carried by an electric motor driven cart that derives its power from on-board batteries. This arrangement does obviate the need for a tow rope, but imposes the considerable expense and weight of a motor driven cart and sufficient batteries to power the cart during a practice session. U.S. Pat. No. 4,995,618 is representative of systems in which the roping target is constrained to move in a circle. In this particular device motivating power is supplied by an engine mounted in the cart that carries the target. The motor imparts movement to the cart by means of speed reduction components connected to a drive wheel under the cart. In devices of this type, the circular track imposed on the target movement is not representative of the path of live target animals. Additionally the engine driven target cart is heavy and difficult to transport from one location to another.

It may be seen then, that the roping practice apparatuses known to the art have numerous disadvantages, and there is an obvious need for a better roping practice system. Accordingly, several object and advantages of this invention are:

a) to provide a roping practice system that does not require an outside power source
b) to provide a roping practice system that does not require electric battery power for movement of the roping target
c) to provide a roping practice system that causes relatively straight line movement of the roping target
d) to provide a means of imparting motion to a roping target by means of a tow rope reel powered by a light, inexpensive, and easily transportable driving means
e) to provide a roping practice system that allows the unaided roper to cause the initiation of movement to a ready, but stationary target while mounted on a horse
f) to provide a roping practice system wherein the roping target comes to a safe stop after traveling a predetermined distance

SUMMARY OF THE INVENTION

This invention improves on the prior art by providing a roping training system that allows an unaided roper to effectively practice the art of roping. The system comprises three basic modules including a simulated animal body roping target portion, a power spring driven rotary reel that winds in a towrope attached to the target, and a latch assembly that restrains motion of the target until released by actuation of the latch by the roper. The simulated animal body target portion is depicted as a steer, but could be other types of animals. This target portion is of wheeled construction, and includes braking means to bring the roping target motion to a stop after a predetermined distance has been traveled. The braking means is kept inactive by the tension of the towrope while the wheeled target is in the ready position, and during the towing phase of the target movement. The rotary reel is such that commercially available hose reels can be effectively used. A stop bumper fixed to the towrope stops the winding in of the towrope by the reel after a predetermined distance of target travel. When this stop bumper stops the towrope windup, the tension on the towrope is relaxed, and the braking means brings the target to a stop. Each of the three modules of the system is of strong but lightweight construction such that an unaided individual can lift each module for transportation.

BRIEF DECRIPTION OF THE DRAWINGS

DETAILED DESCRIPTION OF THE INVENTION

Figure 1:
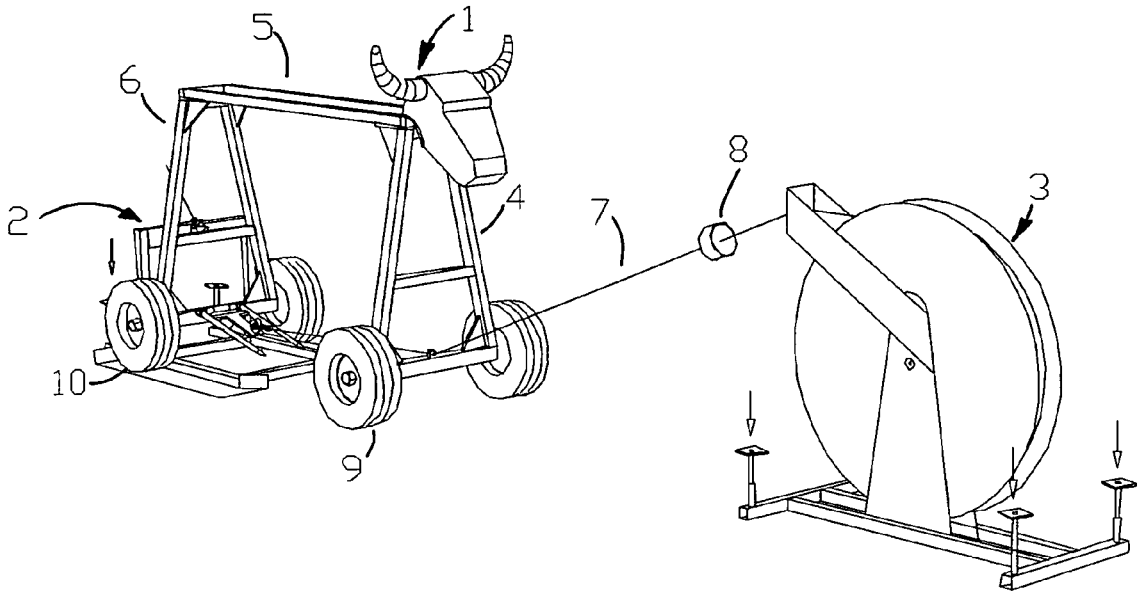
FIG. 1 is a perspective view of the overall practice roping system
Figure 2:
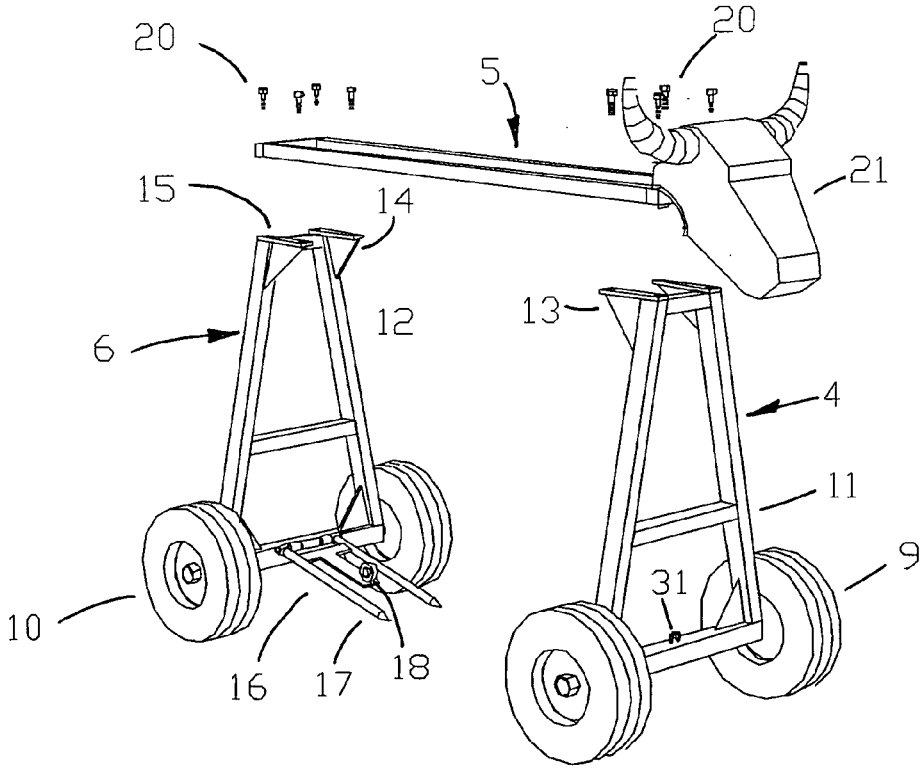
FIG. 2 is a perspective view of the wheeled roping target

With reference to FIG. 1 and FIG. 2, the major modules of this practice roping aid are roping target 1, latch dock assembly 2, towrope reel assembly 3, and towrope 7. Roping target 1 is assembled from three major subassemblies, comprising top frame assembly 5 to which are fixed front frame assembly 4, and rear frame assembly 6 by means of fasteners 20. Top frame assembly 5 is constructed such that any of several commercially available simulated steer heads 21 can be fixed to it. One or more wheels 9 are rotatably fixed to front frame assembly 4 along with front mounting plate 13 and towrope guide 31. Similarly one or more wheels 9 are rotatably fixed to rear frame assembly 6. Brake assembly 16 is rotatably fixed to rear frame assembly 6 such that brake tines 17 are oriented in a generally forward and downward direction with brake connector loop 18 fixed to the front of hinged portion 17.

Figure 3:
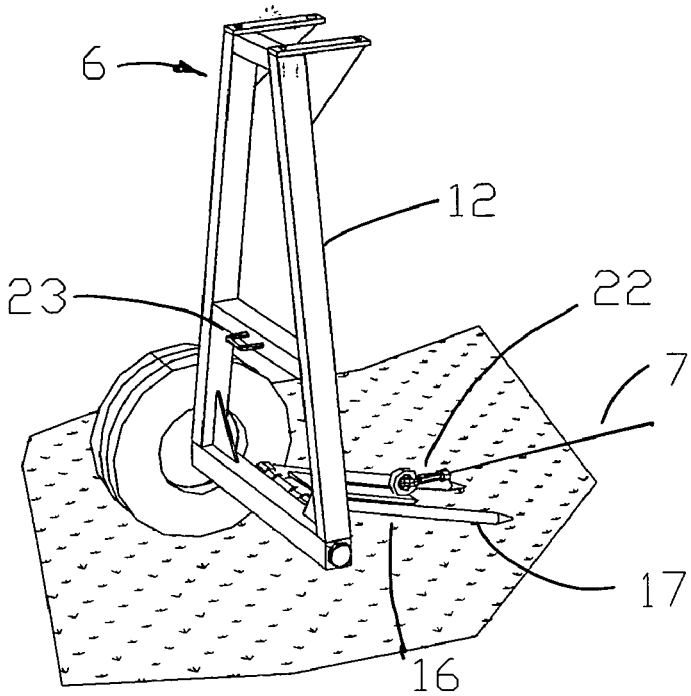
FIG. 3 is expanded view of the rear portion of the target showing brake detail

Referring to FIG. 3, rear frame assembly 6 is shown with latch loop 23 fixed to rear frame 12. Shown in detail is brake assembly 16 rotatably fixed to rear frame 12 by means of brake hinge 19. Towrope 7 is shown connected to brake connector loop 18 by way of towrope hook 22.

Figure 4:
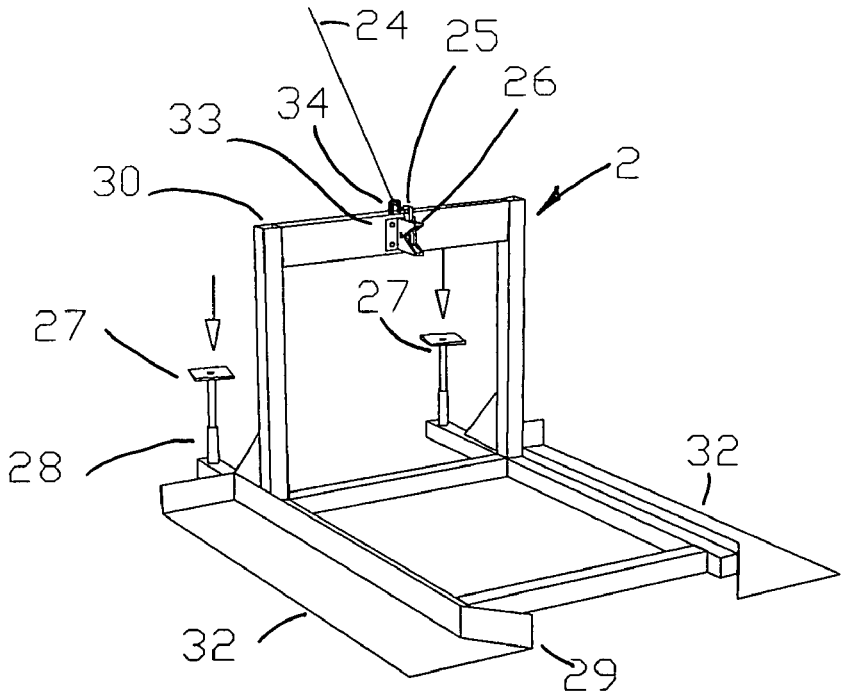
FIG. 4 is a perspective view of the latch dock assembly

With reference to FIG. 4, latch dock assembly 2 is shown in a perspective view. Ground spike guides 28 with respective ground spikes 27 are fixed at the back of latch dock frame 30, and dock guides 29 are formed at the front of wheel tracks 32. Arrows show the direction of operational movement of the ground spikes 27. Latch assembly 33 comprising latch body 26 and latch hook 25 is fixed to the top portion of latch dock assembly 2. Latch lanyard 24 is attached to latch hook 25 and runs through lanyard guide 34.

Figure 5:
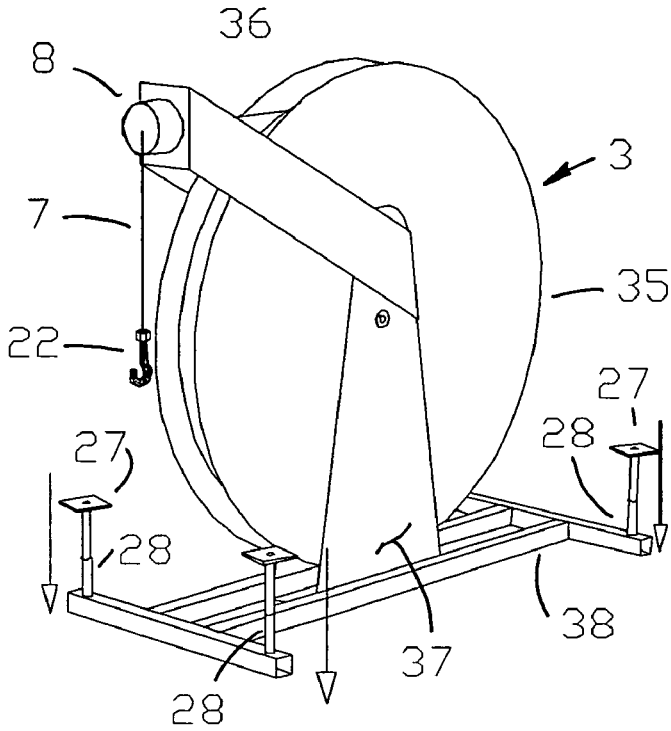
FIG. 5 is a detailed view of the reel assembly

Referring now to FIG. 5, towrope reel assembly 3 is depicted in perspective with towrope 7 wound around towrope reel 35 and extending through reel guide 36 and towrope bumper 8 with towrope hook 22 fixed to the outer end. Towrope reel 35, rotatably supported by reel frame 37, is commonly available as a heavy duty commercial hose reel. The reel frame 37 is itself fixed to reel frame base 38. One or more ground spike guides 28 are fixed to reel frame base 38. Ground spikes 27 are shown slidably located within their respective guides 28 with the direction of operational movement shown by arrows.

Figure 6:
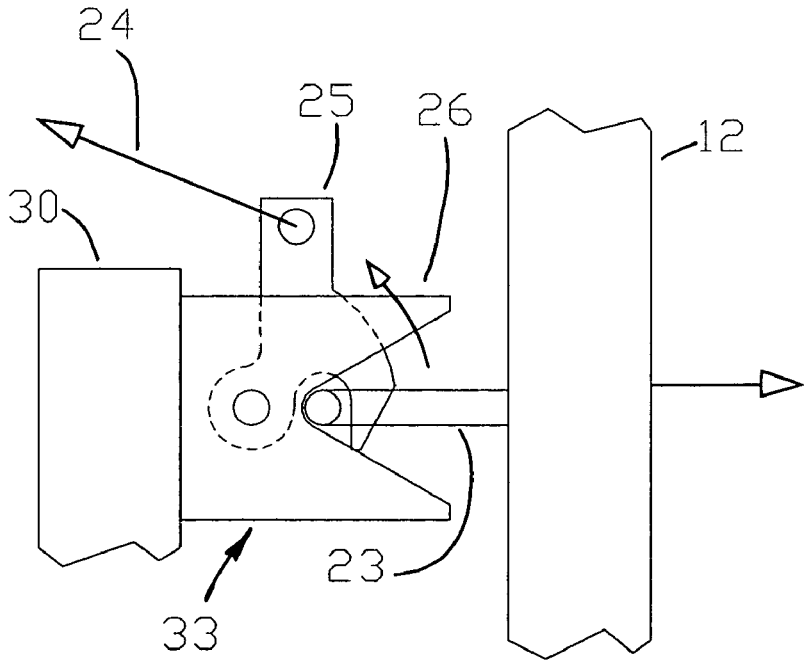
FIG. 6 is an expanded side view of the latch assembly

FIG. 6 shows a side view of latch assembly 33 comprising latch body 26 with latch hook 25 rotably fixed to it. Latch lanyard 24 is tied to latch hook 25 with the direction of operational movement shown by an arrow. A portion of latch dock frame 30 is shown with latch assembly 33 fixed to it. A portion of rear frame 12 of roping target assembly 1 is shown with latch loop 23 locked in place in latch body 26 by latch hook 25. An arrow placed on partial rear frame 12 shows the direction of operational travel of roping target 1.

Figure 7:
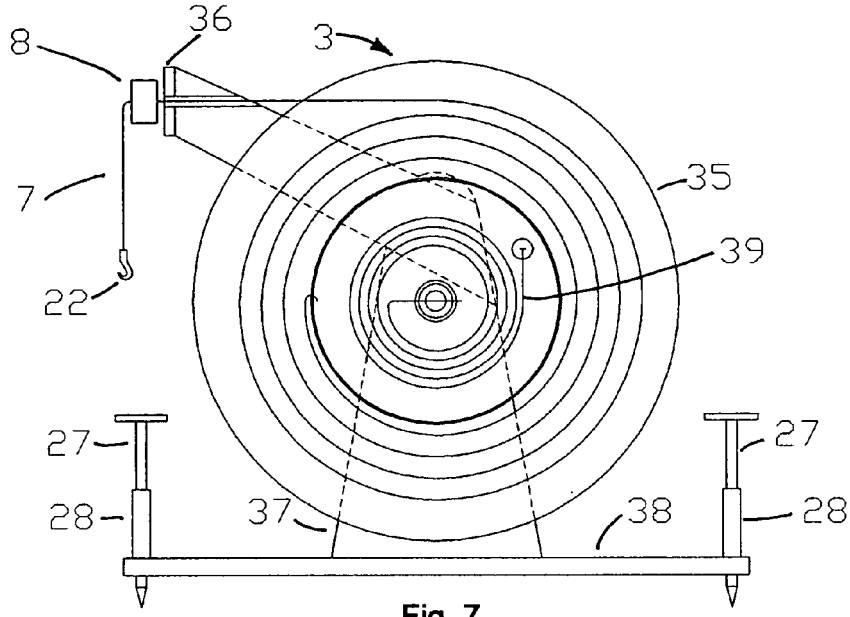
FIG. 7 is a detailed side view of the reel assembly showing the spiral spring

FIG. 7 is a cutaway side view of towrope reel assembly 3 comprising a commonly available commercial heavy-duty hose reel 35 with associated reel spiral spring 39, and hose guide 36. Reel body 35 and reel frame 37 are shown in dashed lines to indicate obscuring by reel body 35 in this figure. Towrope hook 22 is shown fixed to an end of towrope 7 which is pictorially shown as being spirally wound around reel 35. It should be noted that the above description and the associated figures are for explanation of the basic concepts of the invention, and should not be construed as a limitation on the types of play-out and rewind reels that would serve the purpose of this invention. Various common types of electrical cable, water hose, hydraulic hose, or lifting cable reels would all be adaptable for use as towrope reels for the purposes of this invention.

Figures 8A, 8B, 8C:
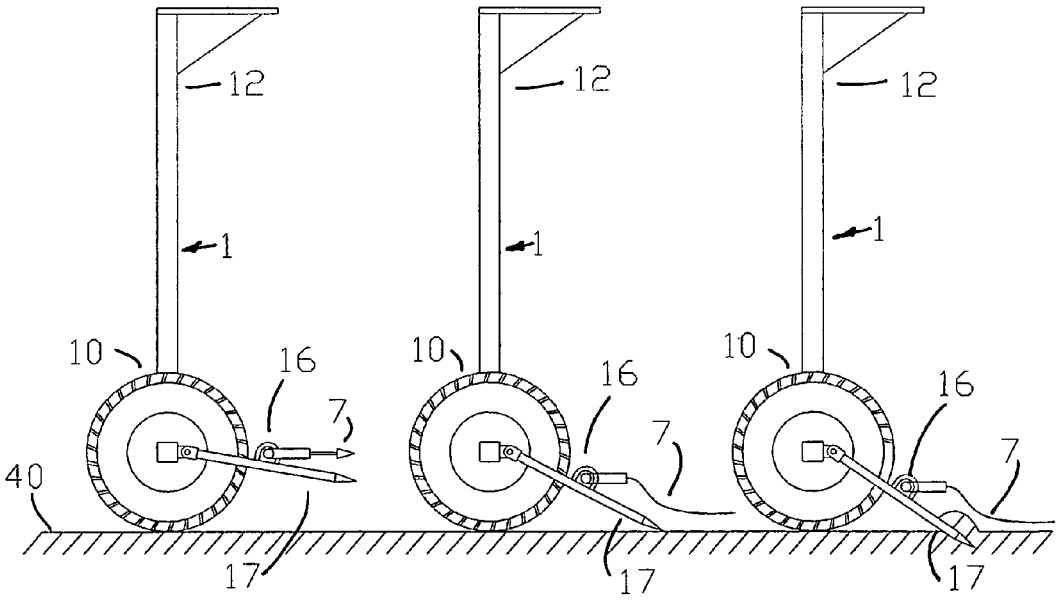
FIGS. 8A, 8B, and 8C depict a sequential view of the brake operation

FIGS. 8A, 8B, and 8C show a partial view of rear frame assembly 6 and roping target assembly 1. Depicted is the progressive braking action of brake assembly 16 of the invention. In FIG. 8A, brake assembly 16 is shown lifted away from the earth 40 by the tension in towrope 7 applied through tow hook 22. In FIG. 8B relaxation of tension in towrope 7 has allowed brake tines 17 to come in contact with earth 40 as inertia continues to move target 1 in the direction shown by the arrow. In FIG. 8C, the final forward movement of target 1 has caused brake tines 17 to pierce the surface of earth 40 sufficiently to bring target 1 to a full stop.

OPERATION OF THE INVENTION

This roping practice system, although effective for practice in roping a variety of animals, is depicted in the figures with a commercially available simulated steer head 21. In a typical operational sequence the user of this roping practice system might transport the system to the practice area in the back of a pickup truck, or SUV. Unlike other roping practice systems, the invention disclosed herein breaks down into subassemblies that can be easily lifted by a single person, and transported in even small SUV's. Arriving at the roping practice area, the user would remove the major subassemblies and place them on the ground. Roping target 1 would then be assembled from the three major subassemblies, comprising top frame assembly 5 to which are fixed front frame assembly 4, and rear frame assembly 6 by means of fasteners 20. At this point in the operation roping target 1 is ready for use. The user would then position towrope reel assembly 3 at a location appropriate to the desired travel of roping target 1, and fix it in place on the ground by driving ground spikes 27 through spike guides 28 into earth 40 with an appropriate hammer.

With towrope reel assembly 3 in place, the user would then position latch dock assembly 2 at the desired starting position for roping target 1 travel during practice. After orienting latch dock assembly 2 with latch assembly 33 pointed generally toward towrope reel assembly 3, the user would then use a common hammer to fix it in place on the ground by driving ground spikes 27 through spike guides 28 into the earth 40.

The user would then roll roping target assembly 1 backwards onto latch dock assembly 2, see FIG. 1, with rear wheels 10 initially guided by dock guides 29 onto wheel tracks 32. See FIG. 4. Continuing to move roping target 1 backward on wheel tracks 32 causes latch loop 23 to come into contact with the tapered front portion of latch body 26, thus guiding it into contact with latch hook 25. The final movement of latch loop 23 first lifts latch hook 25 and then allows it to fall back into place as shown in FIG. 6. In this position, roping target 1 is restrained from movement in the direction of towrope reel assembly 3. When it is desired to allow target 1 to be pulled into motion by towrope reel assembly 3, the user would pull on latch lanyard 24, thus lifting latch hook 25 and releasing latch loop 23. It should be understood that the above description and the associated figures are for clarity of understanding of the concept of the invention only, and various types of commonly available latches and catches would serve the purposes of this invention.

Grasping towrope hook 22, the user would then pull towrope 7 in the direction of target assembly 1 thus causing towrope reel 35 to rotate against the opposing torque which spiral spring 39 exerts on reel 35. See FIG. 7. As the user brings towrope hook 22 to target 1, towrope hook 22 is passed through towrope guide 31 and hooked into brake connector loop 18 on brake assembly 16. See FIG. 2. With the connection of towrope 7 to brake assembly 16 the tension in the towrope causes brake tines 17 to be lifted away from earth 40 as brake assembly 16 rotates slightly about brake hinge 19. See FIG. 8A.

At this point in the operational sequence of the invention, roping target 1 is ready to be released from latch dock 2 for a roping practice run. When ready for a practice run, the user of the system would pull on latch lanyard 24 thus causing latch hook 25 to rotate in latch body 26 releasing latch loop 23. Now released, target 1 is caused to move in the direction of towrope reel assembly 3 by the rewind torque of towrope reel 35 causing towrope 7 to wind up on reel 35.

If the user successfully ropes target 1, the horse will hold the target against the tension in towrope 7 until the user moves the target back in the ready position in latch dock 2 as described above. If the target is not roped prior to the end of its predetermined travel distance, towrope bumper 8 comes in contact with reel guide 36 and stops the movement of the towrope. See FIG. 5. At that moment in time, the inertia of the target will cause it to continue in motion, thus relieving the tension in the towrope. See FIG. 8B. The relaxation of the tension in the towrope will allow the weight of brake assembly 16 to cause rotation of brake assembly 16 such that brake tines 17 first come in contact with earth 40, and then enter earth 40 sufficiently to stop movement of the target. See FIG. 8C.

The sequence can then be repeated by moving the target back into latch dock assembly 2 as described above.

What is claimed is:

1. A roping practice system comprising:

a wheeled roping practice target simulating the animal to be roped;

a latch dock assembly to restrain movement of the roping practice target until movement is desired for a roping practice sequence;

towing means for imparting motion to the roping practice target through a flexible tensile member such as a rope;

braking means to bring the roping practice target to a stop after a predetermined distance of travel;

whereby roping practice may be accomplished by a horse mounted person singularly or with the assistance of another person.

2. The roping practice system of claim 1 wherein the wheeled roping practice target can be dismantled for transport into a plurality of major subassemblies of such weight and size that they can be lifted and stowed by an unaided person in a SUV or larger vehicle.

3. The roping practice system of claim 2 wherein said major subassemblies comprise a top frame assembly, a front frame assembly, and a rear frame assembly.

4. The roping practice system of claim 1 wherein said latch dock assembly comprises a latch dock frame, dock guides, wheel tracks, and latching means to hold the roping practice target until it is released to start a roping practice sequence.

5. The roping practice system of claim 4 wherein said latching means comprises a latch body and latch hook fixed to the latch dock frame, and a latch loop fixed to the roping practice target.

6. The roping practice system of claim 5 wherein said latching means may be caused to release the roping practice target by pulling on a lanyard by either a mounted rider or an assisting person.

7. The roping practice system of claim 1 wherein said towing means comprises a reel with spiral spring disposed such that rotary motion imposed on the reel and spiral spring by pulling on a rope wound around the reel through a guiding portion of the reel will result in a rewinding torque being applied to the rope sufficient to rewind the rope and thereby tow the roping practice target in the desired manner.

8. The roping practice system of claim 1 wherein said braking means comprises hinged brake tines rotatably fixed to the roping practice target in such manner that the tines are kept from contact with the earth while there is sufficient tension in the towrope to move the target, and are allowed to contact the earth when towrope tension is relieved.

9. The roping practice system of claim 8 wherein towrope tension is relieved at a predetermined point by a towrope bumper attached to the towrope is such manner that it stops rewinding of the towrope when said towrope bumper contacts the guiding portion of said towrope reel.

10. A roping practice system comprising:

a wheeled roping practice target simulating the animal to be roped comprising three major subassemblies;

a latch dock assembly comprising a latch dock frame, dock guides, wheel tracks, and latching means to hold the roping practice target until it is released to start a roping practice sequence;

towing means for imparting motion to the roping practice target through tension applied to a flexible tensile member such as a rope;

braking means to bring the roping practice target to a stop after a predetermined distance of travel;

whereby roping practice may be accomplished by a horse mounted person singularly or with the assistance of another person.

11. The roping practice system of claim 10 wherein said latching means comprises a latch body and latch hook fixed to the latch dock frame, and a latch loop fixed to the roping practice target.

12. The roping practice system of claim 11 wherein said latching means may be caused to release the roping practice target by pulling on a lanyard by either a mounted rider or an assisting person.

13. The roping practice system of claim 10 wherein said towing means of imparting motion to the roping practice target comprises a commercially available rewinding hose reel in which a towrope is substituted for the hose.

14. The roping practice system of claim 10 wherein the braking means comprises hinged brake tines rotatably fixed to the roping practice target in such manner that the tines are kept from contact with the earth while there is sufficient tension in the towrope to move the target.

15. The roping practice system of claim 14 wherein said hinged brake tines are moved by their weight to come in contact with the earth when tension in the towrope is relieved.

16. The roping practice system of claim 15 wherein towrope tension is relieved at a predetermined point by a towrope bumper attached to the towrope is such manner that it stops rewinding of the towrope when said towrope bumper contacts said rewinding hose reel.

* * * * *